US006971961B2

(12) United States Patent
Chen

(10) Patent No.: US 6,971,961 B2
(45) Date of Patent: Dec. 6, 2005

(54) CONNECTION STRUCTURE FOR A STRIKING PLATE OF A GOLF CLUB HEAD

(75) Inventor: Chan-Tung Chen, Kaohsiung (TW)

(73) Assignee: Fu Sheng Industrial Co., Ltd., Taipei (TW)

( * ) Notice: Subject to any disclaimer, the term of this patent is extended or adjusted under 35 U.S.C. 154(b) by 22 days.

(21) Appl. No.: 10/388,644

(22) Filed: Mar. 17, 2003

(65) Prior Publication Data

US 2004/0185960 A1 Sep. 23, 2004

(51) Int. Cl.[7] ..... A63B 53/04
(52) U.S. Cl. ..... 473/342; 473/345
(58) Field of Search ..... 473/324–350

(56) References Cited

U.S. PATENT DOCUMENTS 4,792,140 A * 12/1988 Yamaguchi et al. ..... 473/331
5,221,087 A * 6/1993 Fenton et al. ..... 473/342
5,303,922 A * 4/1994 Lo ..... 473/330
5,433,440 A * 7/1995 Lin ..... 473/342
6,050,904 A * 4/2000 Kuo ..... 473/342
6,224,496 B1 * 5/2001 Rowland et al. ..... 473/288
6,450,896 B1 * 9/2002 Chen ..... 473/324
6,749,524 B1 * 6/2004 Chen ..... 473/342

* cited by examiner

*Primary Examiner*—Sebastiano Passaniti
(74) *Attorney, Agent, or Firm*—Bacon & Thomas, PLLC

(57) ABSTRACT

A golf club head includes a club head body, a striking plate, and a bonding layer. The striking plate includes an engaging portion that is engaged with an engaging portion of the striking plate. One of the engaging portion of the striking plate and the engaging portion of the club head body includes at least one groove, and the other includes at least one protrusion. The bonding layer is applied between the engaging portion of the club head body and the engaging portion of the striking plate. The groove and the protrusion of the engaging portion of the club head body and the engaging portion of the striking plate increase a contact area between the club head body and the striking plate, thereby improving a bonding strength between the club head body and the striking plate.

7 Claims, 4 Drawing Sheets

CONNECTION STRUCTURE FOR A STRIKING PLATE OF A GOLF CLUB HEAD

BACKGROUND OF THE INVENTION

1. Field of the Invention

The present invention relates to a connection structure for a striking plate of a golf club head.

2. Description of Related Art

A typical golf club head includes a striking plate that is engaged with the club head body by insertion, argon welding, hard soldering or high energy welding. Nevertheless, these methods have their respective disadvantages. More specifically, the striking plate is apt to be deformed when engaged with the club head body by insertion. Problems would arise if the material for the club head body is different from that for the striking plate when using welding. And it takes a long time to proceed with vacuuming or handling of inert gas for preventing oxidation of the metal surfaces when high energy welding such as laser welding or plasma welding is adopted.

To overcome the above disadvantages, a bonding technique using high strength resin at room temperature has been proposed. FIG. 1 of the drawings illustrates a conventional iron club head having a club head body 10 and a striking plate 20. The club head body 10 has a recessed portion 11 in a front side thereof for receiving the striking plate 20. When bonding, glue is merely applied to an outer periphery 21 and a bonding portion 22 of the striking plate 20, allowing the bonding at room temperature. Nevertheless, since the bonding strength of the high strength bonding agent has its limitation and since the striking plate 20 is subject to a shear force up to 4100 psi when striking a golf ball, the is no guarantee to maintain the bonding between the club head body 10 and the striking plate 20 although the bonding process saves time for manufacture.

OBJECTS OF THE INVENTION

An object of the present invention is to provide a golf club head including a club head body and a striking plate bonded to the club head body, wherein the bonding strength between the club head body and the striking plate is increased by means of increasing the bonding area therebetween.

Another object of the present invention is to provide a golf club head including a club head body and a striking plate that can be assembled together in a rapider manner.

SUMMARY OF THE INVENTION

To achieve the aforementioned objects, the present invention provides a golf club head including a club head body, a striking plate, and a bonding layer. The club head body includes an engaging portion on a front side thereof. The striking plate includes an engaging portion on a rear side thereof. The engaging portion of the striking plate is engaged with the engaging portion of the club head body. One of the engaging portion of the striking plate and the engaging portion of the club head body includes at least one groove, and the other of the engaging portion of the striking plate and the engaging portion of the club head body includes at least one protrusion. The bonding layer is applied between the engaging portion of the club head body and the engaging portion of the striking plate. The groove and the protrusion of the engaging portion of the club head body and the engaging portion of the striking plate increase a contact area between the club head body and the striking plate, thereby improving a bonding strength between the club head body and the striking plate.

In another embodiment of the invention, the groove and the protrusion are replaced with an inner flange and an outer flange which are preferably zigzag to further increase the bonding effect between the club head body and the striking plate.

Other objects, advantages and novel features of this invention will become more apparent from the following detailed description when taken in conjunction with the accompanying drawings.

DETAILED DESCRIPTION OF THE PREFERRED EMBODIMENTS

Figure 2:
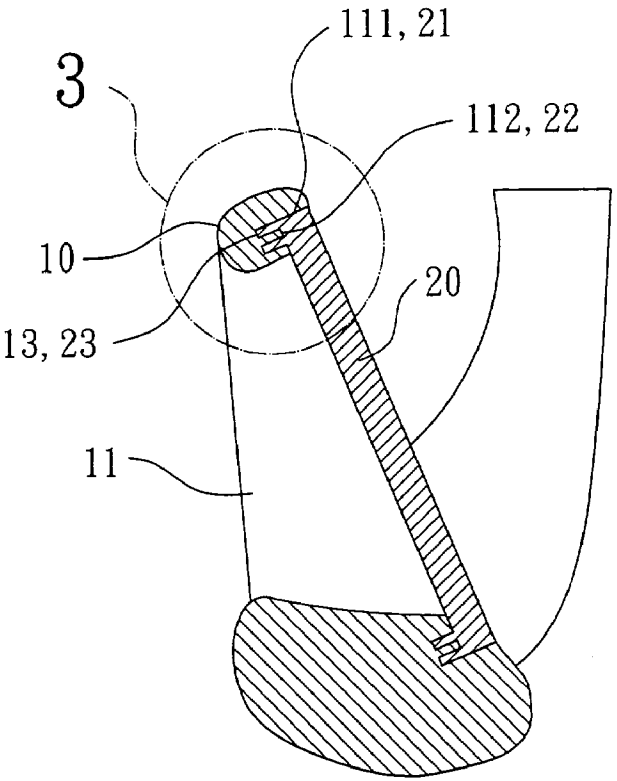
FIG. 2 is a sectional view of a first embodiment of a club head in accordance with the present invention.

The present invention is now to be described hereinafter in detail, in which the same reference numerals are used for the same parts as those in the prior art.

Figure 3:
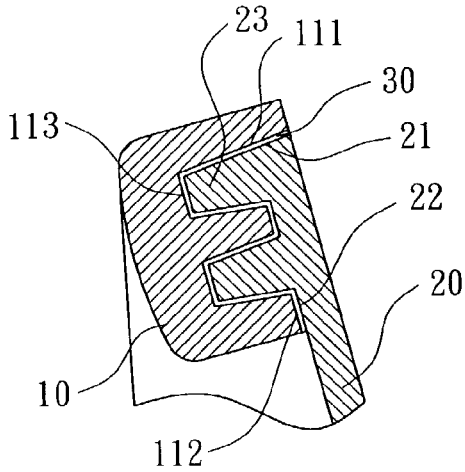
FIG. 3 is an enlarged view of a circle in FIG. 2.

Referring to FIGS. 2 and 3, a golf club head in accordance with the present invention includes a club head body 10, a striking plate 20, and a bonding layer 30. The club head body 10 may be a club head body for an iron club, a wooden club, or a putter. The club head body 10 includes a recessed portion 11 for receiving the striking plate 20. The recessed portion 11 includes an inner periphery 111 and an engaging portion 112 that has at least one groove 113.

The striking plate 20 is a metal plate formed by means of casting, forging, or machining. The striking plate 20 includes an outer periphery 21 for engaging with the inner periphery 111 of the recessed portion 11 of the club head body 10. The striking plate 20 further has an engaging portion 22 on a lip on a rear side thereof. The engaging portion 22 of the striking plate 20 engages with the engaging portion 112 of the recessed portion 11 of the club head body 10. The engaging portion 22 includes at least one protrusion 23 for engaging with the groove 113 of the engaging portion 112 of the recessed portion 11 of the club head body 10.

The bonding layer 30 is preferably formed after solidification of a high strength bonding agent that may withstand the shear force which is generated at the time of striking a golf ball and which may be up to 4000 psi. Examples of the high strength bonding agent includes epoxy or a bonding agent composed of two or more bonding agent components.

Figure 1:
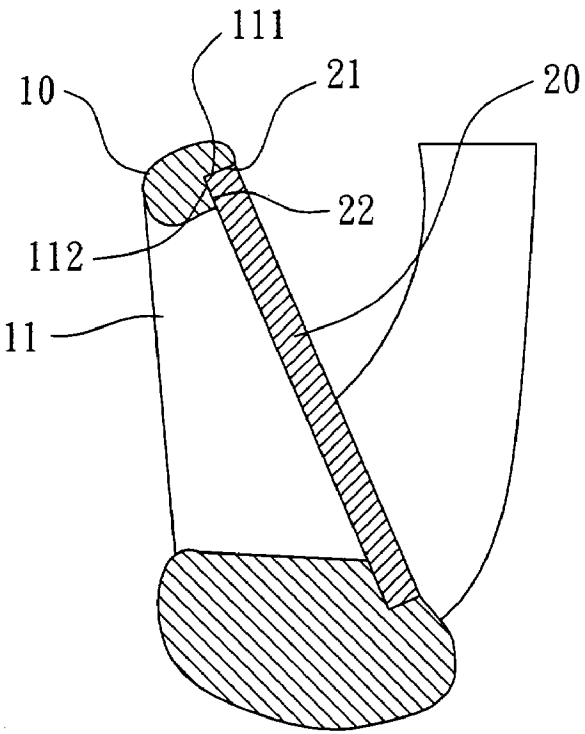
FIG. 1 PRIOR ART
FIG. 1 is a sectional view of a conventional iron club head.

In this embodiment, one of the groove 113 and the protrusion 23 has a rectangular or trapezoidal section that is complimentary to that of the other. This increases the contact area between the club head body 10 and the striking plate 20. The bonding layer 30 has an agent-applied area greater than that of the conventional club head in FIG. 1. Thus, the shear force-withstanding capability of the striking plate 20 is increased. The bonding strength is improved and the life of the club head is prolonged accordingly.

The groove 113 and the protrusion 23 in this embodiment are preferably provided in a continuous manner and represent ring-shaped patterns on the engaging portion 112 of the club head body 10 and the engaging portion 22 of the striking plate 20, respectively. The number of the groove 113 and the protrusion 23 can be changed according to need. Further, when forming the bonding layer 30 by epoxy, the thickness of the bonding layer 30 is preferably more than 0.2 mm. When the bonding agent includes two bonding agent components, the bonding process can be proceeded at 60–120° C. to accelerate the solidification of the bonding agent.

Figure 4:
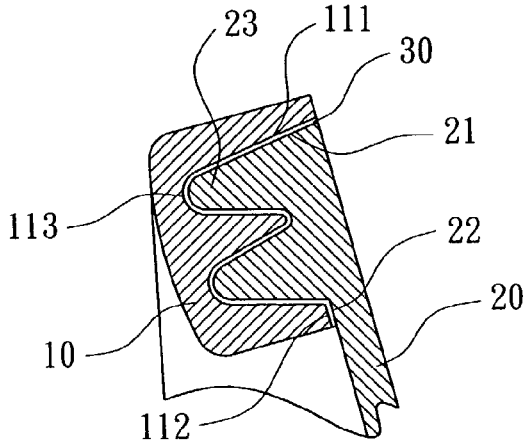
FIG. 4 is a view similar to FIG. 3, illustrating a second embodiment of the club head in accordance with the present invention.
Figure 5:
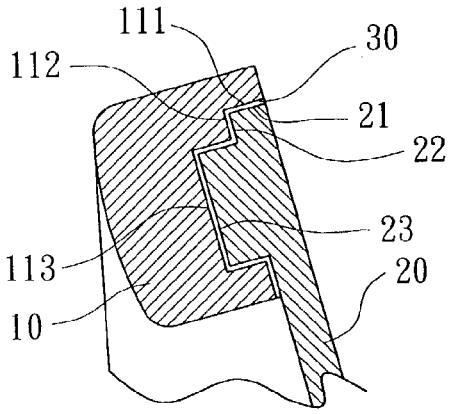
FIG. 5 is a view similar to FIG. 3, illustrating a third embodiment of the club head in accordance with the present invention.
Figure 6:
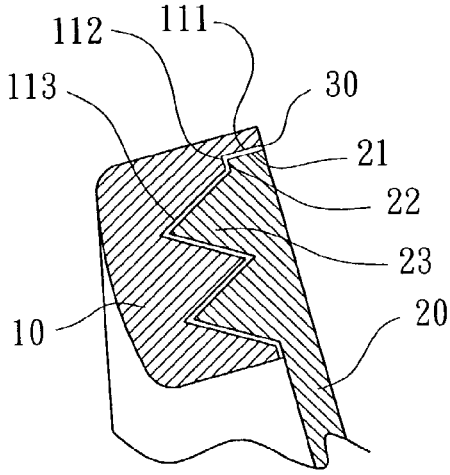
FIG. 6 is a view similar to FIG. 3, illustrating a fourth embodiment of the club head in accordance with the present invention.

FIG. 4 illustrates a second embodiment of the club head. In this embodiment, the club head body 10 includes a cone-shaped section with a rounded apex in the groove 113, and the protrusion 23 of the striking plate 20 includes a cone-shaped section complimentary to that of the groove 113 of the club head body 10. FIG. 5 illustrates a third embodiment of the club head. In this embodiment, the club head body 10 includes a stair-like section in the groove 113, and the protrusion 23 of the striking plate 20 includes a stair-like section complimentary to that of the groove 113 of the club head body 10. FIG. 6 illustrates a fourth embodiment of the club head. In this embodiment, the club head body 10 includes a triangular section in the groove 113, and the protrusion 23 of the striking plate 20 includes a triangular section complimentary to that of the groove 113 of the club head body 10. These grooves 113 and protrusions 23 can be formed in a continuous or discontinuous manner on the engaging portion 112 of the club head body 10 and the engaging portion 22 of the striking plate 20, respectively.

Figure 7:
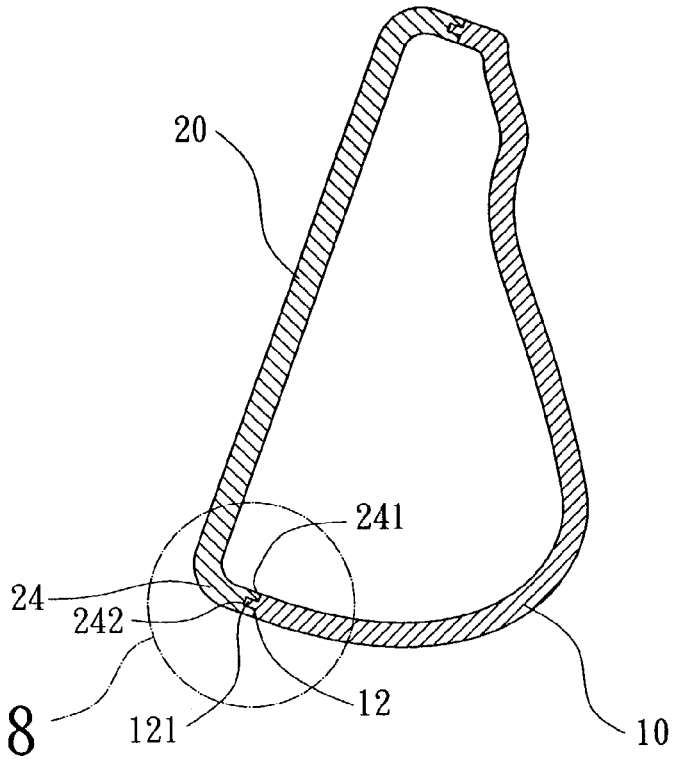
FIG. 7 is a sectional view of a fifth embodiment of the club head in accordance with the present invention.

FIG. 7 illustrates a fifth embodiment of the invention, wherein the club head is an iron club head having a club head body 10 and a striking plate 20. An engaging portion 12 is directly formed on a periphery of a front side of the club head body 10, and an annular wall 24 is formed on the striking plate 20 by means of bending a periphery of a front side of the striking plate 20. Thus, the effective striking area is increased to the maximum, with the striking plate 20 being capable of being instantly deformed to the maximum to obtain a high coefficient of restitution (COR). Such an iron club is suitable for long-range striking.

Figure 8:
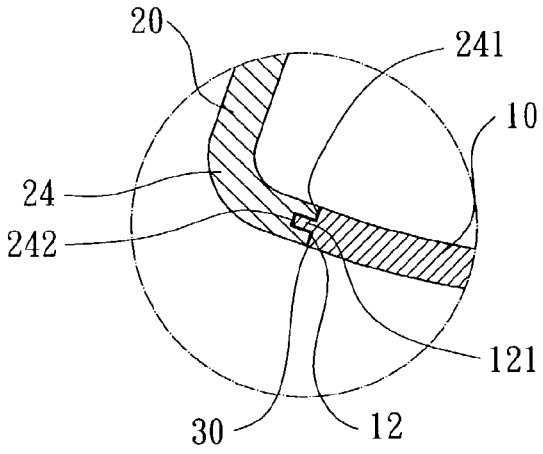
FIG. 8 is an enlarged view of a circle in FIG. 7.

As illustrated in FIGS. 7 and 8 illustrating the fifth embodiment of the invention, to improve the contact area between the club head body 10 and the striking plate 20, the engaging portion 12 of the club head body 10 includes a protrusion 121, and the annular wall 24 of the striking plate 20 includes an engaging portion 241 in the form of a groove 242 that is complimentary in shape to the protrusion 121. Again, the agent-applied area of the bonding layer 30 is increased to thereby improve the bonding strength between the club head body 10 and the striking plate 20. Again, the protrusion 121 and the groove 242 can be formed in a continuous or discontinuous manner on the engaging portion 12 of the club head body 10 and the engaging portion 241 of the striking plate 24, respectively.

Figure 9:
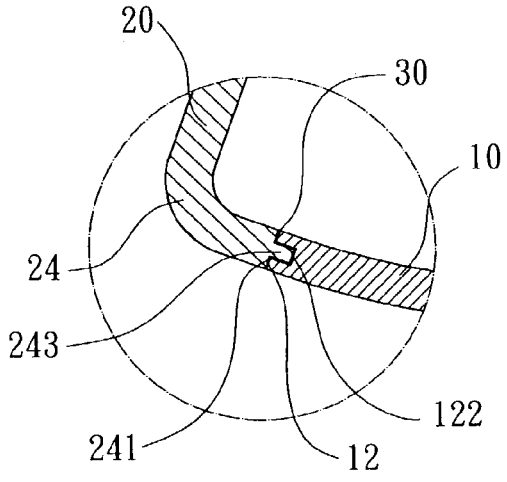
FIG. 9 is a view similar to FIG. 8, illustrating a sixth embodiment of the club head in accordance with the present invention.
Figure 10:
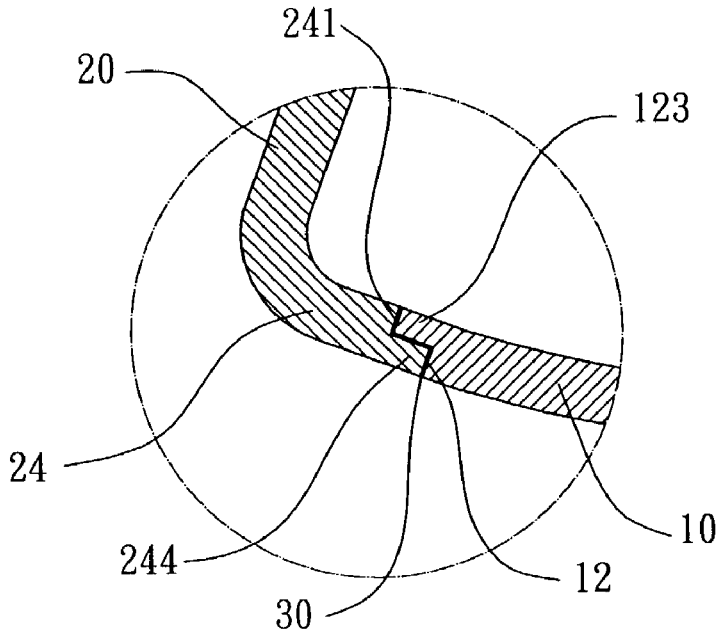
FIG. 10 is a view similar to FIG. 8, illustrating a seventh embodiment of the club head in accordance with the present invention.
Figure 11:
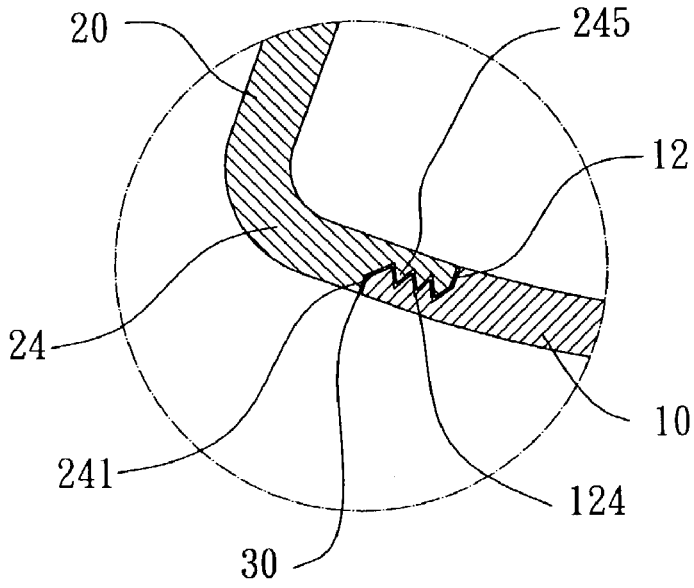
FIG. 11 is a view similar to FIG. 8, illustrating an eight embodiment of the club head in accordance with the present invention.

FIG. 9 illustrates a sixth embodiment of the invention, wherein the engaging portion 12 of the club head body 10 includes a groove 122, and the engaging portion 241 of the striking plate 20 includes a protrusion 243 complimentary in shape to the groove 122 of the club head body 10. FIG. 10 illustrates a seventh embodiment of the invention, the engaging portion 12 of the club head body 10 includes an inner flange 123, and the engaging portion 241 of the striking plate 24 includes an outer flange 244 that is complimentary in shape to the inner flange 123 of the club head body 10. FIG. 11 illustrates an eighth embodiment of the invention, wherein the engaging portion 12 of the club head body 10 includes a zigzag inner flange 124, and the engaging portion 241 of the striking plate 24 includes a zigzag outer flange 245 that is complimentary in shape to the zigzag inner flange 124 of the club head body 10. The zigzag flanges 124 and 245 further increase the agent-applied area for the bonding layer 30, thereby further improving the bonding strength between the club head body 10 and the striking plate 20. Again, the protrusions 122, 123, 124 and the groove 243, 244, 245 can be formed in a continuous or discontinuous manner on the engaging portion 12 of the club head body 10 and the engaging portion 241 of the striking plate 24, respectively.

In conclusion, the bonding strength between the club head body 10 and the striking plate 20 is improved, as the contact area between the engaging portion 12 of the club head body 10 and the engaging portion 22, 241 of the striking plate 20 is increased. The manufacturing time is shortened, and the life of the club head is prolonged.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A golf club head comprising:

a club head body including an annular lip and a front-end engaging portion on a front peripheral side thereof, said front-end engaging portion being located on a front surface of said annular lip;

a striking plate including an annular bent wall and a rear-end engaging portion on a rear peripheral side thereof, said rear-end engaging portion being located on a rear surface of said annular bent wall so that the annular bent wall corresponds to an annular lip of the club head body and separates said rear-end engaging portion from a striking area of said striking plate to maximize the striking area, the engaging portion of the striking plate being engaged with the engaging portion of the club head body so that an engagement area of said striking plate with said club head body is positioned behind the striking area of said striking plate, one of the rear-end engaging portion of the striking plate and the front-end engaging portion of the club head body including at least one groove, the other of the engaging portion of the striking plate and the engaging portion of the club head body including at least one protrusion, wherein positioning of the engagement area of said striking plate behind the striking area of the said striking plate displaces said engagement area from said striking area to maximize the striking area and an ability of said striking plate to endure deformation; and an adhesive layer sandwiched between the front-end engaging portion of the club head body and the rear-end engaging portion of the striking plate, wherein said at least one groove and said at least one protrusion of the front-end engaging portion of the club head body and the rear-end engaging portion of the striking plate increases a contact area between the club head body and the striking plate, thereby improving a bonding strength between the club head body and the striking plate.

2. The golf club head as claimed in claim 1, wherein said at least one groove is formed on the front-end engaging portion of the club head body, and wherein said at least one protrusion is formed on the rear-end engaging portion on the annular bent wall of the striking plate.

3. The golf club head as claimed in claim 1, wherein said at least one protrusion is formed on the front-end engaging portion of the club head body, and wherein said at least one groove is formed on the rear-end engaging portion on the annular wall of the striking plate.

4. The golf club head as claimed in claim 1, wherein one of said at least one protrusion and said at least one groove has a section in a shape of one of a rectangle, trapezoid, a cone with a rounded apex, a stair-like structure, a triangle, and wherein the other said at least one protrusion and said at least one groove has a section that is complimentary to said one of said at least one protrusion and said at least one groove.

5. The golf club head as claimed in claim 1, wherein said at least one groove and said at least one protrusion are provided in a continuous manner on the front-end engaging portion of the club head body and the rear-end engaging portion of the striking plate.

6. The golf club head as claimed in claim 1, wherein said at least one groove and said at least one protrusion are provided in a discontinuous manner on the front-end engaging portion of the club head body and the rear-end engaging portion of the striking plate.

7. The golf club head as claimed in claim 1, wherein the bonding layer has a thickness not less than 0.2 mm.

* * * * *